US007308996B2

(12) United States Patent
Tanaka et al.

(10) Patent No.: US 7,308,996 B2
(45) Date of Patent: Dec. 18, 2007

(54) GAS COMBUSTION-TYPE IMPACT DEVICE

(75) Inventors: Hiroshi Tanaka, Tokyo (JP); Satoshi Osuga, Tokyo (JP); Yasushi Yokochi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/566,261

(22) PCT Filed: Jul. 30, 2004

(86) PCT No.: PCT/JP2004/011280

§ 371 (c)(1),
(2), (4) Date: Jan. 30, 2006

(87) PCT Pub. No.: WO2005/011924

PCT Pub. Date: Feb. 10, 2005

(65) Prior Publication Data

US 2006/0237513 A1 Oct. 26, 2006

(30) Foreign Application Priority Data

Jul. 31, 2003 (JP) ..... 2003-283663

(51) Int. Cl.
*B25C 1/08* (2006.01)

(52) U.S. Cl. ..... 227/10; 123/46 R; 227/130

(58) Field of Classification Search ..... 227/9–11, 227/130; 123/46 H, 46 R
See application file for complete search history.

(56) References Cited

U.S. PATENT DOCUMENTS 4,403,722 A 9/1983 Nikolich ..... 277/8
5,909,836 A 6/1999 Shkolnikov et al. ..... 227/8
6,619,527 B1 * 9/2003 Moeller ..... 227/10
6,695,195 B2 * 2/2004 Nishikawa et al. ..... 227/10
6,755,159 B1 * 6/2004 Adams et al. ..... 123/46 R
6,863,045 B2 * 3/2005 Ricordi ..... 123/262
6,951,194 B2 * 10/2005 Nishikawa et al. ..... 123/46 R
6,983,871 B2 * 1/2006 Shima et al. ..... 227/8
2002/0144498 A1 * 10/2002 Adams ..... 60/39.6
2005/0156007 A1 * 7/2005 Nishikawa et al. ..... 227/10
2006/0151565 A1 * 7/2006 Nishikawa et al. ..... 227/10
2006/0186165 A1 * 8/2006 Nishikawa et al. ..... 227/10
2006/0225674 A1 * 10/2006 Ohtsu et al ..... 123/46 H

FOREIGN PATENT DOCUMENTS

CN 1080624 C 3/2002
EP 0913234 A1 * 5/1999

(Continued)

*Primary Examiner*—Stephen F. Gerrity
(74) *Attorney, Agent, or Firm*—Morgan, Lewis & Bockius LLP

(57) ABSTRACT

An injection nozzle 21 for injecting a combustible gas into an annular combustion chamber 10 formed above a driving cylinder 4 is formed so as to face the interior of the combustion chamber 10, in which a rotary fan 24 for mixing a combustion gas supplied into the combustion chamber 10 and air is provided. A vortex generator 33 is formed in an upstream side of the injection nozzle 21 in an air flow formed in the combustion chamber 10 by the rotary fan. Vortexes are generated near the injection nozzle 21 in the combustion chamber 10 by the vortex generator 33, so that the mixing of the combustion gas and air is promoted.

13 Claims, 6 Drawing Sheets

FOREIGN PATENT DOCUMENTS

| | | |
|---|---|---|
| JP | 63-207569 | 8/1988 |
| JP | A-63-207569 | 8/1988 |
| JP | A-02-153221 | 6/1990 |
| JP | B-03-025307 | 4/1991 |
| JP | A-06-330775 | 11/1994 |

* cited by examiner

GAS COMBUSTION-TYPE IMPACT DEVICE

TECHNICAL FIELD

The present invention relates to a gas combustion type impact tool, in which a gaseous mixture is formed by mixing a combustible gas and air in a combustion chamber formed on an upper side of a driving cylinder. A driving piston held in the driving cylinder is driven by pressure from combustion gas generated by combusting the gaseous mixture in the combustion chamber, and thus a nail striking operation and the like are carried out.

BACKGROUND ART

As an example of the gas combustion type impact tool, a combustion gas driven nailing machine is known, which is adapted to inject a combustible gas into a sealed combustion chamber and form a gaseous mixture of the combustible gas and air therein, burn the gaseous mixture in the combustion chamber, generate a high-pressure combustion gas therein, exert the high-pressure combustion gas on a driving piston held in a driving cylinder, drive the driving piston with an impact thereon to strike a nail into a steel plate and concrete by a driver coupled to a lower surface of the driving piston. In such a combustion gas driving nailing machine, a container, such as a gas bottle filled with a combustible gas, is fixed in the machine. A battery is used as an electric power source for igniting the combustible gas. The combustion gas driving nailing machine is thus formed as a portable machine. This enables a nail and a pin driving operation to be carried out without being restricted by a power supply source, such as an electric power source and a compressed air supply source.

In the combustion gas driving nailing machine, a cylinder slidably holding a driving piston therein is provided in the housing. On the lower surface of the driving piston, a nail striking driver is connected. The driver is held and guided in a nail discharge port formed in a nose coupled to a lower portion of the housing. When the driving piston is driven in the driving cylinder, the driver joined to the driving piston is driven with an impact in the nail discharge port. A nail supplied to the interior of the nail discharge port of the nose is driven from the nail discharge port toward a work provided at a free end of the nose.

At an upper portion of the driving cylinder, an annular combustion chamber is formed. This combustion chamber is defined by an annular sleeve forming a circumferential wall of the combustion chamber, an upper wall formed by an upper housing, and an upper end surface of the driving piston. A combustion gas formed in this combustion chamber works on the driving piston, so that the driving piston is driven in the driving cylinder. In the combustion chamber, an injection nozzle for injecting a combustible gas put in a gas container, such as a cartridge, is formed so that the injection nozzle is opened therein. A rotary fan is used for generating a gaseous mixture of a predetermined air/fuel ratio by mixing the combustible gas injected into the combustion chamber with the air therein is further formed. The rotary fan is rotated by an electric motor, and the combustible gas injected into the combustion chamber and the air existing in advance therein are agitated, the gaseous mixture being thereby formed in the combustion chamber.

The combustion chamber is further provided therein with an ignition device used to ignite the gaseous mixture generated in the combustion chamber, and burn the gaseous mixture explosively therein. The ignition device is usually made of an ignition plug and the like for generating sparks by discharging a high voltage. When an operator actuates a trigger formed at a base portion of a grip formed so as to extend in the rearward direction of the housing so as to be integral therewith, the ignition device is operated to generate sparks in the combustion chamber. As a result, the gaseous mixture in the combustion chamber is ignited, and the nailing machine is driven (refer to JP-B-03-025307).

As described above, a gas combustion type impact tool in the related art may have a large air flow generated in the combustion chamber by a fan rotated by an electric motor. The air flow and the combustible gas may be injected via the injection nozzle, and the combustible gas and the air in the combustion chamber may be agitated in the whole region of the combustion chamber, a gaseous mixture being thereby formed. Therefore, the mixing of the combustible gas and air in the combustion chamber cannot be efficiently carried out, and it takes much time before the air/fuel ratio of the gaseous mixture in the whole region of the interior of the combustion chamber attains a level at which the condition in which the gaseous mixture can be ignited by the sparks generated by the ignition device is obtained. As a result, when the sparks are generated from the ignition device by operating the trigger immediately after the formation of the gaseous mixture is started with the combustible gas being supplied into the combustion chamber, the combustion of the gaseous mixture is not carried out. When it takes much time to form the gaseous mixture, an operation response is low, so that the operation efficiency is spoiled.

DISCLOSURE OF THE INVENTION

The present invention aims to provide a gas combustion type impact tool capable of efficiently agitating a combustible gas injected into a combustion chamber with air in the combustion chamber, and reliably igniting a gaseous mixture in the combustion chamber.

To achieve this object, the gas combustion type impact tool according to the present invention is formed so that the impact tool is driven by a driving piston held in an annular combustion chamber formed at an upper portion of a driving cylinder, and by supplying a combustible gas into the combustion chamber and forming a gaseous mixture of the air and a combustion gas in the combustion chamber, burning the gaseous mixture by igniting the gaseous mixture in the combustion chamber, and exerting a combustion gas pressure, which is generated by this gaseous mixture burning operation, on the driving piston so as to drive the driving piston. An injection nozzle for injecting the combustible gas into the combustion chamber is formed so that the nozzle faces the interior of the combustion chamber, a rotary fan for mixing the combustible gas supplied into the combustion chamber and the air therein being provided. A vortex generator is formed in a portion of the air flow generated in the combustion chamber by the rotary fan, which is on an upstream side of the injection nozzle. Vortexes are generated in the position close to the injection nozzle in the combustion chamber by the vortex generator to thereby promote the mixing of the combustible gas and air.

Another gas combustion type impact tool is formed so that the impact tool is driven by a driving piston held in an annular combustion chamber formed at an upper portion of a driving cylinder, and by supplying a combustible gas into the combustion chamber and forming a gaseous mixture of the air and a combustion gas in the combustion chamber, burning the gaseous mixture by igniting the same in the chamber, and exerting a combustion gas pressure, which is generated from this gaseous mixture burning operation, on the driving piston so as to drive the same. A rotary fan for use in mixing the combustible gas supplied into the combustion chamber and the air therein with each other is provided. Also provided is an ignition device adapted to ignite the gaseous mixture formed in the combustion chamber therein. A retention generator is formed in the portion of the air flow formed in the combustion chamber by the rotary fan, which is on the downstream side of the ignition device, the retention generator being for easily generating a retention of the gaseous mixture formed by the rotary fan near the ignition device.

Still another gas combustion impact tool is formed so that the impact tool is driven by a driving piston held in an annular combustion chamber formed at an upper portion of a driving cylinder, and by supplying a combustible gas into the combustion chamber and forming a gaseous mixture of the air and a combustion gas in the combustion chamber, burning the gaseous mixture by igniting the same in the combustion chamber, exerting a combustion gas pressure, which is generated by this gaseous mixture burning operation, on the driving piston so as to drive the same. An injection nozzle for injecting the combustible gas into the combustion chamber and an ignition device for igniting the gaseous mixture generated in the combustion chamber are formed so that both the injection nozzle and ignition device face the interior of the combustion chamber. A rotary fan by which the combustible gas supplied into the combustion chamber and the air therein are mixed with each other are formed in the same chamber. A vortex generator is formed in the portion of the air flow generated in the combustion chamber by the rotary fan, which is on the upstream side of the injection nozzle. A vortex is generated near the injection nozzle in the combustion chamber by the vortex generator, the mixing of the combustion gas and air being thereby promoted. A retention generator is formed in the portion of the air current generated in the combustion chamber by the rotary fan, which is on the downstream side of the ignition device, a retention of the gaseous mixture generated by the rotary fan being easy to be generated near the ignition device by the retention generator.

The vortex generator provided on the upstream side of the injection nozzle and the retention generator provided on the downstream side of the ignition device may be formed by a common vortex and retention generator in the combustion chamber.

The vortex generator in the portion of the air current generated by the rotary fan in the combustion chamber is formed on the upstream side of the injection nozzle, and the vortexes generated near the injection nozzle in the combustion chamber by the vortex generator so that the agitation of the combustion gas injected into the combustion chamber and the air therein is promoted by the vortexes. Therefore, the agitation of the combustible gas and the air in the combustion chamber can be carried out efficiently. It also becomes possible to quickly carry out the generation of the gaseous mixture at a predetermined air/fuel ratio in the combustion chamber, and quicken the time at which the gaseous mixture can be ignited.

The retention generator is formed along the portion of the flow of the gaseous mixture generated in the combustion chamber by the rotary fan which is on the downstream side of the ignition device, and renders it easy to collect the gaseous mixture, which is generated by the rotary fan, near the ignition device. Therefore, the air/fuel ratio of the gaseous mixture which is around the ignition device attains a level at which the gaseous mixture can be ignited quickly. Since the gaseous mixture can be ignited quickly, the igniting of the gaseous mixture by a triggering operation can be done in a short period of time after the starting of the supplying of the combustible gas into the combustion chamber.

The vortex generator is formed on the upstream side of the injection nozzle, and the vortexes are generated near the injection nozzle in the combustion chamber, by which vortexes the agitation of the combustible gas, which is injected into the combustion chamber, and the air therein is promoted. The retention generator is formed on the downstream side of the ignition device, and makes it easy to collect the gaseous mixture, which is generated by the rotary fan, near the ignition device, so that the agitation of the combustible gas and air in the combustible chamber can be carried out efficiently. Moreover, the air/fuel ratio of the gaseous mixture around the ignition device quickly attains a level at which the gaseous mixture can be ignited. Therefore, the igniting of the gaseous mixture becomes able to be done more quickly.

Since the vortex generator provided on the upstream side of the injection nozzle and the retention generator provided on the downstream side of the ignition device are formed by a common vortex and retention generator in the combustion chamber, the construction of the nailing machine becomes simple, and the reduction of the cost can be attained.

Figure 1:
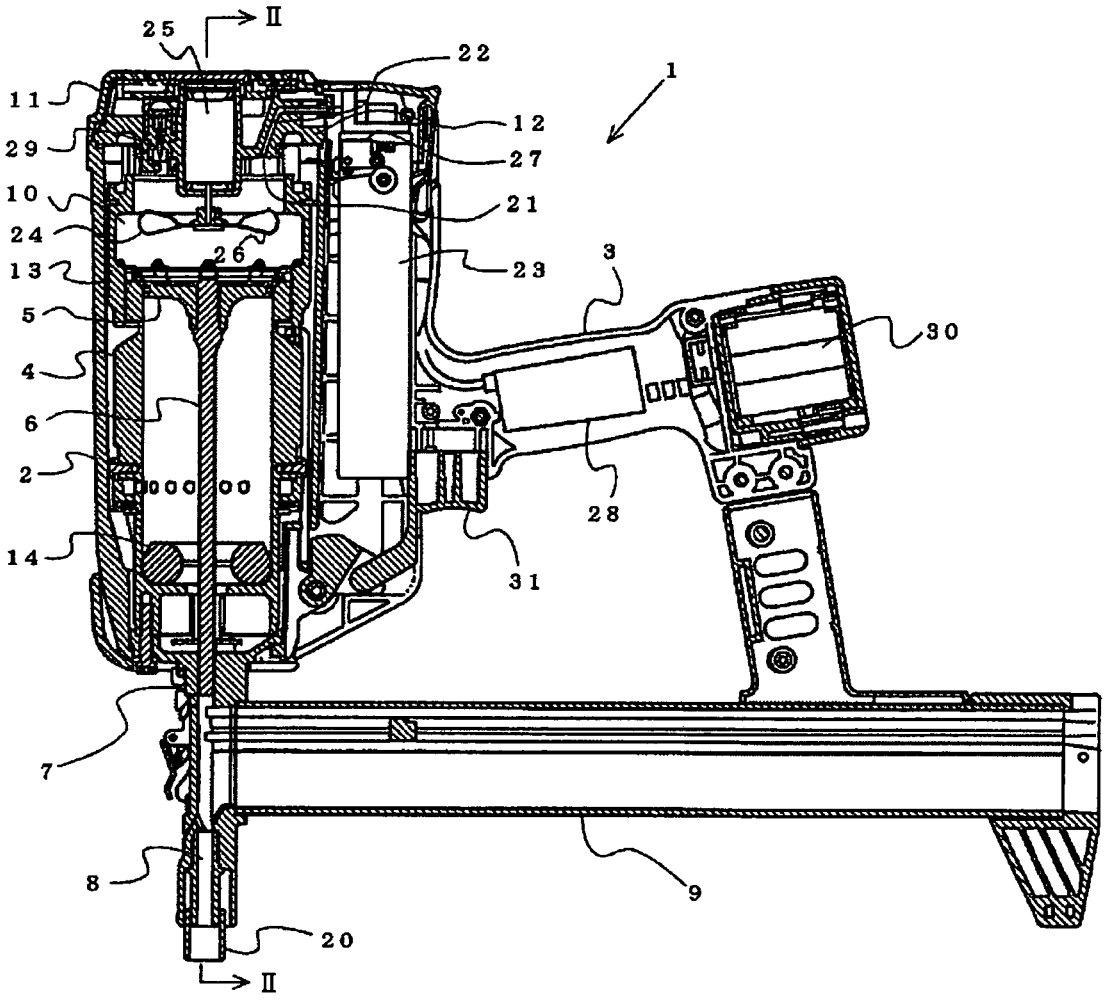
FIG. 1 is a longitudinally sectioned side elevation of the combustion gas driven nailing machine in an embodiment of the gas combustion type impact tool according to the present invention.

Referring to the drawings, a reference numeral 1 denotes a combustion gas driven nailing machine (gas combustion type impact tool), 4 a driving cylinder, 5 a driving piston, 10 a combustion chamber, 11 an upper housing, 12 an upper wall, 13 a movable sleeve, 21 an injection nozzle, 24 a rotary fan, 29 an ignition device, 33 a barrier wall member (vortex generator), and 34 a barrier wall member (retention generator).

BEST MODE FOR CARRYING OUT THE INVENTION

FIG. 1 shows a combustion gas driven nailing machine representing an embodiment of the gas combustion type impact tool according to the present invention. In the combustion gas driven nailing machine 1, a driving cylinder 4 is held in a housing 2 on which a rearwardly extending grip 3 is formed so as to be integral therewith as shown in FIG. 1. In this driving cylinder 4, a driving piston 5 to a lower surface of which a nail striking driver 6 is joined is slidably housed. In a lower portion of the housing 2, a nose 7 having a nail discharge port 8 adapted to guide nails to be guided toward a work is fixed. The driver 6 joined to the driving piston 5 is slidably held and guided in the nail discharge port 8 of the nose 7. On the rear side of this nose 7, a magazine 9 filled with a plurality of nails is fixed in a connected state, and the nails in the magazine 9 are supplied in order into the nail discharge port 8. The nails supplied to the interior of the nail discharge port 8 are struck by the driver 6 and brought out of the nail discharge port 8 into the work.

Above the driving cylinder 4, a combustion chamber 10 for forming a gaseous mixture of the combustible gas and air and burning this gaseous mixture is formed. The combustion chamber 10 is formed by a movable annular sleeve 13 provided between an upper end portion of the driving cylinder 4 to which an upper end surface of the driving piston 5 is exposed, and an upper wall 12 formed in the interior of an upper housing 11. The pressure of the combustion gas generated by forming the gaseous mixture of the combustible gas and air in the combustion chamber 10 and burning the resultant gaseous mixture is exerted on the driving piston 5, which is thereby driven to the position of a bumper 14 provided in a lower dead center in the driving cylinder 4.

The movable sleeve 13 forming the combustion chamber 10 is provided slidably in the direction of the operation of the driving piston 5. Before the nailing machine 1 is started, the movable sleeve 13 is in a lower position, and communicates with the atmospheric air via an air vent 15 and a passage 16 formed between an outer circumferential surface of the driving cylinder 4 and an inner circumferential surface of the housing 2. When the nailing machine is started, the movable sleeve 13 is operated to an upper position, and the upper end portion of the movable sleeve 13 is closely engaged with an O-ring 17 provided on the upper wall with the lower end portion of the movable sleeve 13 closely engaged with an O-ring 18 provided on an outer circumference of the driving cylinder 4. As a result, the interior of the combustion chamber is shut off from the atmospheric air.

Figure 2:
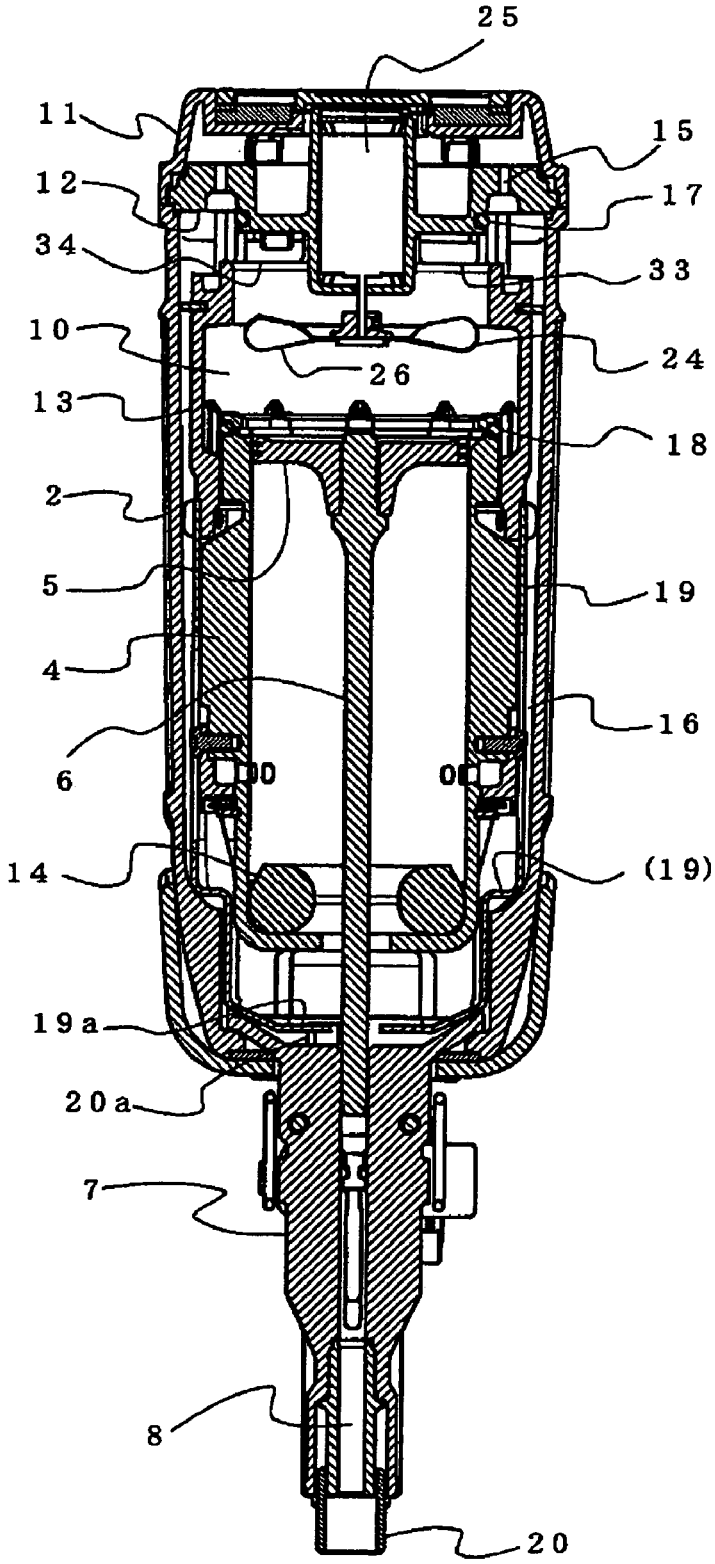
FIG. 2 is a sectional view taken along the line II-II in FIG. 1.

As shown in FIG. 2, the lower end of the movable sleeve 13 is joined to a link member 19 provided in a space formed between the inner circumferential surface of the housing and the outer circumferential surface of the driving cylinder 4. When this link member 19 is operated upward, the movable sleeve 13 is moved up, so that the interior of the combustion chamber 10 is shut off from the air vent 15 and passage 16. A lower end portion 19*a* of the link member 19 is provided in the lower portion of the driving cylinder 4 which is above the nose 7. The lower end portion 19*a* of the link member 19 is connected to an upper end portion 20*a* of a contact member 20 provided so as to project toward a free end of the nail discharge port 8 of the nose 7. Therefore, when the nose 7 of the nailing machine 1 is pressed against the work, the contact member 20 is operated, and the movable sleeve 13 is operated upward via the link member 19, so that the interior of the combustion chamber 10 is shut off from the atmospheric air.

In the upper housing 11 forming the upper wall 12 of the combustion chamber 10, an injection nozzle 21 facing at a free end portion thereof the interior of the combustion chamber 10 so as to inject the combustible gas into the same chamber 10 is formed. A gas supply passage 22 joined to the injection nozzle 21 is connected to a gas container, such as a gas cylinder filled with the combustible gas. When the nose 7 is pressed against the work so as to start the nailing machine 1, the movable sleeve 13 is operated upward, and the interior of the combustion chamber 10 is shut off from the atmospheric air. A predetermined quantity of combustible gas is thereafter supplied from the gas container 23 to the interior of the combustion chamber 10 via the gas supply passage 22.

The upper housing 11 is provided therein with a rotary fan 24 used to generate the gaseous mixture of a predetermined air/fuel ratio in the combustion chamber 10 by agitating the combustible gas injected into the combustion chamber 10 and the air therein. The rotary fan 24 has radially provided vanes 26 which are rotated along the circumferential wall of the combustion chamber 10 by an electric motor 25 held in a recess formed in the upper housing 11. The air in the combustion chamber 10 is moved along the circumferential wall thereof by rotation of this rotary fan 24, and a circumferential flow of air occurs in the combustion chamber 10. The driving of the rotary fan 24 is controlled by a control board 28 provided in an inner portion of a grip 3, in accordance with an operation of a switch 27 actuated with an upward movement of the movable sleeve 13.

The upper housing 11 is further provided with an ignition device 29 for igniting and burning the gaseous mixture generated in the combustion chamber 10. The ignition device 29 is formed by a general ignition plug adapted to generate sparks by increasing a voltage of a battery 30 provided in a rear end portion of the grip 3 to a high level, and discharging the high voltage. When sparks are generated in the combustion chamber 10 in which the gaseous mixture is formed, the gaseous mixture is ignited and burnt, and a high-pressure combustion gas is generated in the combustion chamber 10. The ignition device 29 is driven via the control board 28 on the basis of a switch 32 operated by the trigger 31 formed at a base portion of the grip 3.

Figure 3:
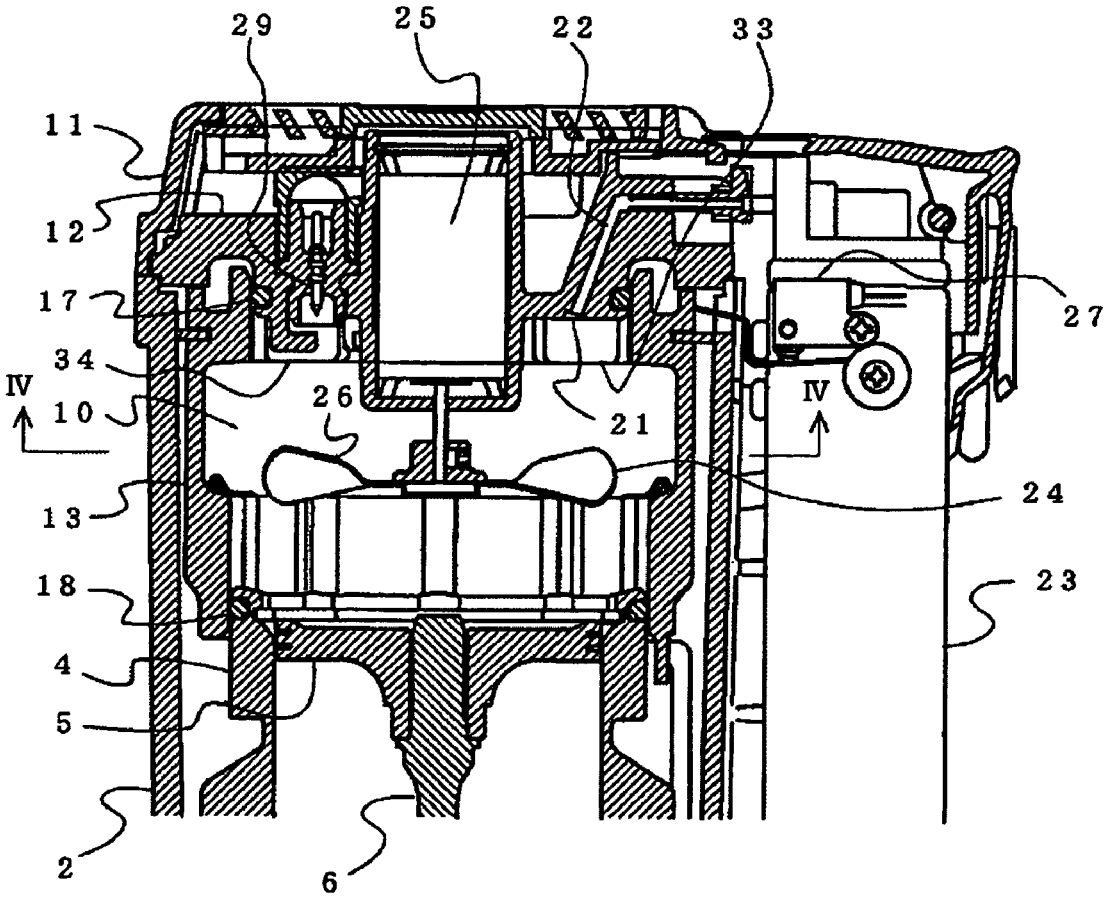
FIG. 3 is a longitudinally sectioned side elevation showing an enlarged principal portion of the combustion gas driven nailing machine of FIG. 1.
Figure 4:
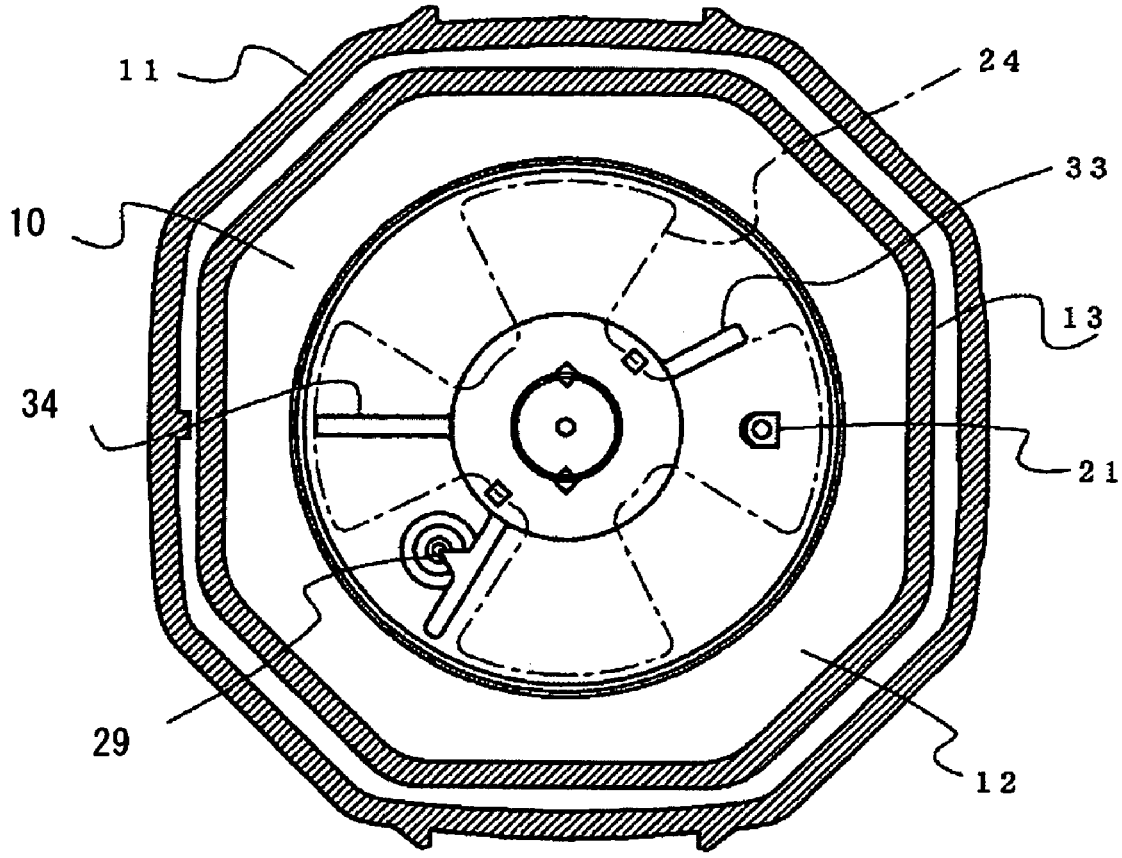
FIG. 4 is a sectional view taken along the line IV-IV in FIG. 3.
Figure 5:
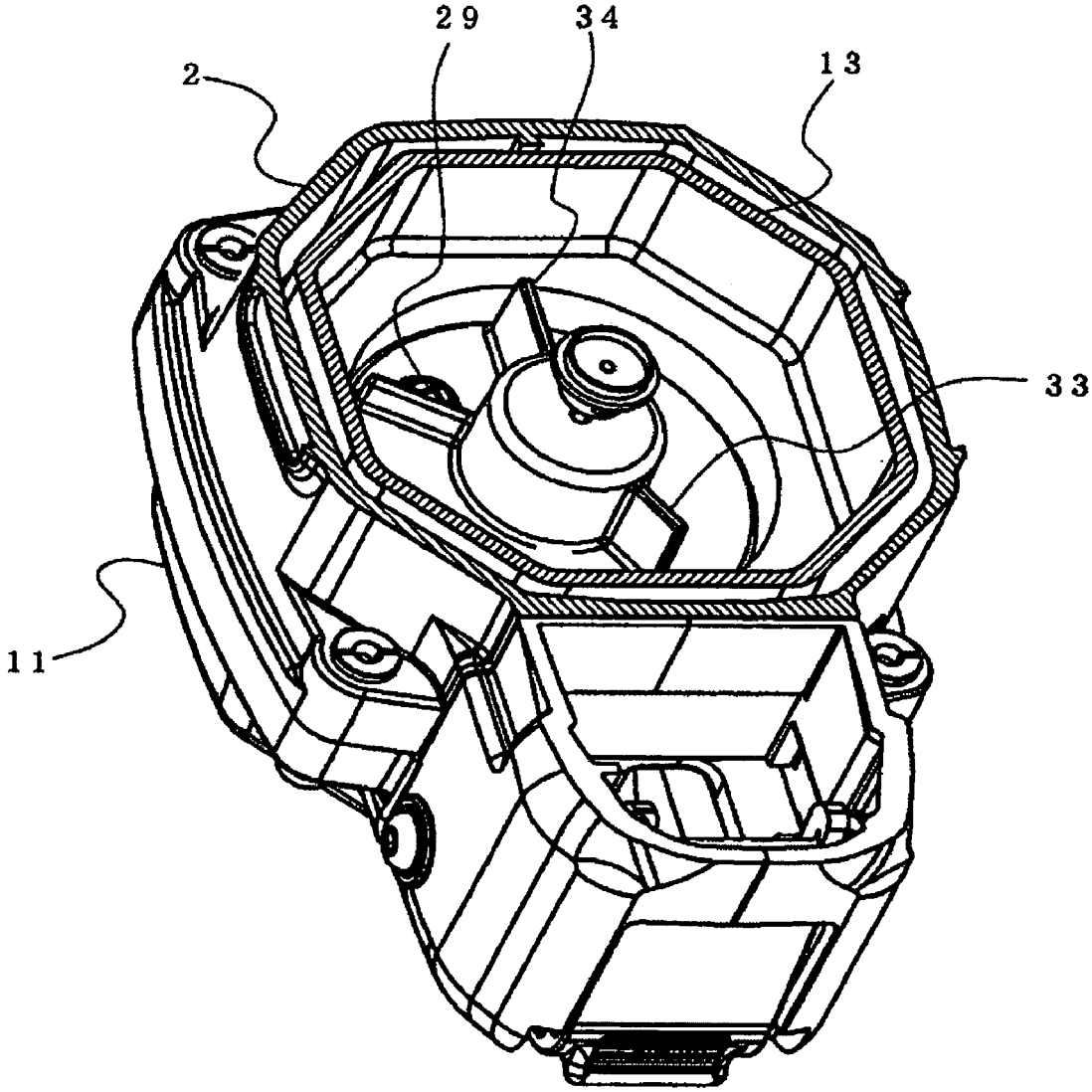
FIG. 5 is a perspective view showing an upper wall portion of a combustion chamber formed in the upper housing.

As shown in FIG. 3 to FIG. 5, the upper wall 12 of the upper housing 11 forming the combustion chamber 10 is provided with a barrier wall member 33 as a vortex generating means (vortex generator) extending from the center of the combustion chamber 10 in the radially outward direction so as to block a circumferential air flow, which is generated in the combustion chamber 10 by the rotary fan 24, in such a manner that the barrier member 33 is formed on the portion of the upper wall 12 of the upper housing 11 which is on the upstream side of the injection nozzle 21 so as to project from the same upper wall 12 into the interior of the combustion chamber 10. This barrier wall member 33 causes vortexes, which are due to the turbulence of the air flow, to occur in the portion of the interior of the combustion chamber 10 which is on the downstream side of the barrier wall member 33 in which the injection nozzle 21 is formed, and the combustible gas is injected into this portion of this combustion chamber 10 from the injection nozzle 21. This combustible gas and air are agitated by fine vortexes efficiently, so that the formation of the gaseous mixture is carried out in a short period of time.

The upper wall 12 of the upper housing 11 is further provided on the downstream side of the ignition device 29, which extends along the circumferential air flow generated by the rotary fan 24 in the combustion chamber 10, with barrier wall member 34 as a retention generating means (retention generator) extending from the center of the combustion chamber 10 in the radially outward direction so as to block the flow of the gaseous mixture in the combustion chamber 10, the barrier wall member 34 projecting from the surface of the same upper wall 12 of the upper housing into the interior of the combustion chamber 10. Owing to this barrier wall member 34, the gaseous mixture just obtained by agitating the combustible gas injected into the combustion chamber and the air therein is collected around the ignition device 29, and the gaseous mixture around the ignition device 29 is set to such an air/fuel ratio that permits the gaseous mixture in the combustion chamber 10 to be ignited reliably.

Figure 6:
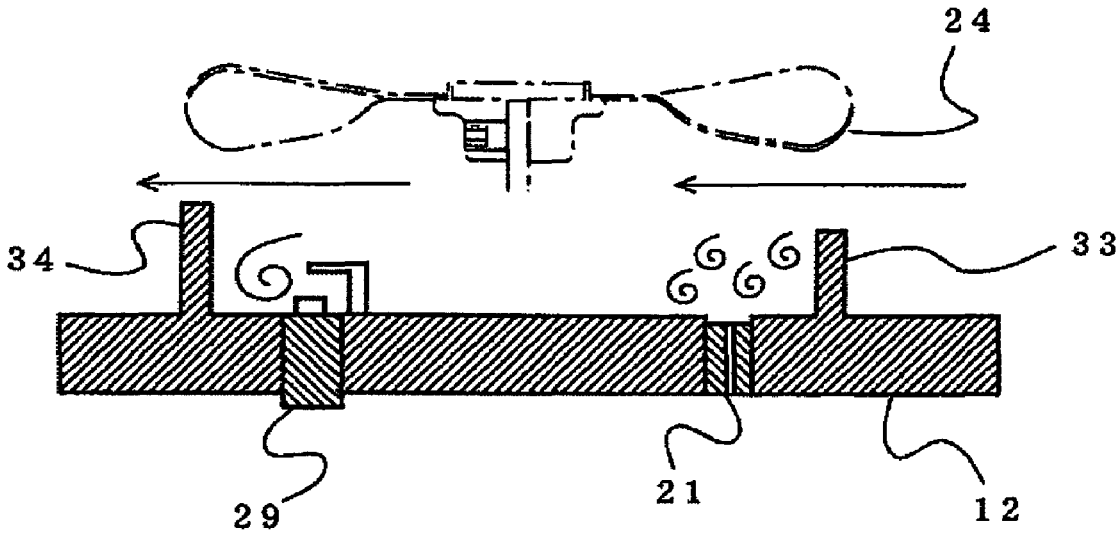
FIG. 6 is a development of the combustion chamber, used to describe the operation of a barrier wall member.

FIG. 6 shows the annular combustion chamber 10 in development for the convenience of the description thereof. The operation of the present invention based on the air flow generated in the combustion chamber 10 by the rotary fan 24 will be described on the basis of what is shown in this drawing. In the annular combustion chamber 10, the air flow circulating therein as shown by arrows in the drawing is generated. A part of the air flow is blocked by the barrier wall member 33 formed on the upstream side of the injection nozzle 21 which is adapted to inject the combustible gas into the combustion chamber 10, and the turbulence of the air flow occurs on the downstream side of the barrier member 33, so that a plurality of fine vortexes occur. The combustible gas is injected from the injection nozzle 21 into the vortexes on the downstream side of the barrier wall member 33 in the interior of the combustion chamber 10. Owing to these vortexes of the air, the combustible gas is agitated efficiently. As a result, the formation of an ignitable gaseous mixture is carried out quickly.

Owing to the barrier wall 34 formed on the downstream side of the ignition device 29 with respect to the direction of the air flow in the combustion chamber 10, the flow of the gaseous mixture just formed by agitating as mentioned above the combustible gas injected from the injection nozzle 21 into the combustion chamber 10 and the air therein is blocked. On the upstream side of the barrier wall member 34, a gaseous mixture having an air/fuel ratio representing a high concentration of the combustible gas is collected, and the air/fuel ratio of the gaseous mixture around the ignition device is set so that this gaseous mixture can be ignited quickly. As a result, the igniting of the gaseous mixture by the ignition device 29 can be done quickly.

According to the embodiment of the present invention described above, the barrier wall member 33 for blocking the air flow in the combustion chamber 10 is formed on the upstream side of the injection nozzle, so that a plurality of fine vortexes occur on the downstream side of the barrier wall member 33. Since the combustible gas is injected into these vortexes via the injection nozzle 21, the formation of ignitable gaseous mixture in the combustion chamber 10 can be carried out quickly. Since the barrier wall member 34 for blocking the flow of the gaseous mixture is formed on the downstream side of the ignition device 29, the gaseous mixture just obtained by agitating the combustible gas injected into the combustion chamber 10 and the air therein is collected around the ignition device 29. Therefore, the air/fuel ratio of the gaseous mixture around the ignition device 29 is set to a level which permits the gaseous mixture to be quickly ignitable. As a result, the igniting of the gaseous mixture by an operation of the trigger 31 can be done in a short period of time after the starting of the supplying of the combustible gas into the combustion chamber 10. Therefore, the operation response of the nailing machine is improved, and a speedy operation can be attained.

In this embodiment, the barrier wall member 33 as the vortex generating means (vortex generator) formed on the upstream side of the injection nozzle 21, and the barrier wall 34 as the retention generating means (retention generator) formed on the upstream side of the ignition device 29 are all formed by barrier wall members having surfaces extending at right angles to the direction of the flow of the air and gaseous mixture. The vortex generating means (vortex generator) formed on the upstream side of the injection nozzle 21 can also be practically used even when the vortex generator has a structure (for example, a hole, a columnar member, an air blowout nozzle and the like) other than a barrier wall member as long as the structures can generate vortexes around the combustible gas injected into the combustion chamber 10. The retention generating means (retention generator) formed on the downstream side of the ignition device 29 can employ a structure in which the diaphragm for guiding the flow of the gaseous mixture is formed so that the gaseous mixture just obtained by agitating the combustible gas and air is guided to a position around the ignition device 29 instead of the structure having the above-described barrier wall member 34. Even such a diaphragm-employed structure can obtain the same effect.

The barrier wall member may be formed on the downstream side of the ignition device for the air flow formed in the combustion chamber by the rotary fan and on the upstream side of the injection nozzle. This barrier wall member may thereby be formed so as to have functions of both the vortex generating means (vortex generator) and retention generating means (retention generator).

INDUSTRIAL APPLICABILITY

The object of enabling the ignition of a gaseous mixture by the ignition device to be carried out quickly by igniting the gaseous mixture of a predetermined air/fuel ratio, which is formed efficiently by agitating the combustible gas and air in the combustion chamber, was met by generating an air flow in the combustion chamber by the rotary fan, and agitating the combustible gas injected into the combustion chamber and the air therein by vortexes generated on the downstream side of the vortex generator which is formed on the upstream side of the injection nozzle. The object was also met by forming the retention generator, which is used to make the gaseous mixture collected easily near the ignition device, on the downstream side of the ignition device.

The invention claimed is:

1. A gas combustion type impact tool comprising:

a combustion chamber that comprises an upper wall and an adjacent side wall;

a driving cylinder;

a driving piston opposite the upper wall, held in the driving cylinder and driven by an exertion of a combustion gas pressure occurring when a gaseous mixture including a combustible gas and air is burnt in the combustion chamber;

an injection nozzle formed to face an interior of the combustion chamber and injecting the combustible gas into the combustion chamber;

a rotary fan for mixing the combustible gas supplied into the combustion chamber and the air in the combustion chamber;

an ignition device provided in the combustion chamber and igniting the gaseous mixture in the combustion chamber; and a vortex generator, provided on the upper wall on an upstream side of the injection nozzle in an air flow generated in the combustion chamber by the rotary fan, for generating a vortex near the injection nozzle in the combustion chamber so as to promote a mixing of the combustible gas and the air, and the vortex generator located between the injection nozzle and the rotary fan.

2. The gas combustion type impact tool according to claim 1, wherein the vortex generator comprises a barrier wall member projecting into the combustion chamber.

3. The gas combustion type impact tool according to claim 1, further comprising:

a retention generator, provided on the upper wall, spaced from the vortex generator and the ignition device, and located on a downstream side of the ignition device in the air flow generated in the interior of the combustion chamber by the rotary fan, for generating a retention of the gaseous mixture mixed by the rotary fan near the ignition device.

4. The gas combustion type impact tool according to claim 3, wherein the retention generator comprises a barrier wall member projecting into the interior of the combustion chamber.

5. The gas combustion type impact tool according to claim 3, wherein the vortex generator and the retention generator are structured by a common member.

6. The gas combustion type impact tool according to claim 1, wherein the rotary fan is spaced from the upper wall of the combustion chamber and the vortex generator is disposed between the upper wall and the fan.

7. The gas combustion type impact tool according to claim 1, wherein the injection nozzle and the ignition device are disposed on the upper wall of the combustion chamber.

8. The gas combustion type impact tool according to claim 7, wherein the vortex generator is proximate the injection nozzle.

9. A gas combustion type impact tool, comprising:

a combustion chamber that comprises an upper wall;

a driving cylinder;

a driving piston held in the driving cylinder and driven by an exertion of a combustion gas pressure occurring when a gaseous mixture including a combustible gas and air is burnt in the combustion chamber;

an injection nozzle formed to face an interior of the combustion chamber and injecting the combustible gas into the combustion chamber;

a rotary fan for mixing the combustible gas supplied into the combustion chamber and the air in the combustion chamber;

an ignition device provided in the combustion chamber and igniting the gaseous mixture in the combustion chamber; and a retention generator, provided on the upper wall of the combustion chamber, the retention generator extending radially outward along the upper wall from a location proximate a downstream side of the ignition device in an air flow generated in an interior of the combustion chamber by the rotary fan, for generating a retention of the gaseous mixture mixed by the rotary fan near the ignition device, and the retention generator located between the ignition device and the rotary fan.

10. The gas combustion type impact tool according to claim 9, wherein the retention generator comprises a barrier wall member projecting into the combustion chamber.

11. The gas combustion type impact tool according to claim 9, further comprising:

a vortex generator, provided on an upstream side of the injection nozzle in the air flow generated in the combustion chamber by the rotary fan, for generating a vortex near the injection nozzle in the combustion chamber so as to promote a mixing of the combustible gas and the air.

12. The gas combustion type impact tool according to claim 11, wherein the vortex generator comprises a barrier wall member projecting into the combustion chamber.

13. The gas combustion type impact tool according to claim 11, wherein the vortex generator and the retention generator are structured by a common member.

* * * * *